US005586768A

United States Patent [19]

Pavonetti

[11] Patent Number: 5,586,768

[45] **Date of Patent: * Dec. 24, 1996**

[54] COLLAPSIBLE/PORTABLE SOCCER GOAL

[76] Inventor: Onofrio F. Pavonetti, 78 Dunwoodie St., Scarsdale, N.Y. 10583

[ * ] Notice: The term of this patent shall not extend beyond the expiration date of Pat. No. 5,372,368.

[21] Appl. No.: 354,477

[22] Filed: Dec. 12, 1994

[51] Int. Cl.[6] ..... A63B 63/00

[52] U.S. Cl. ..... 273/411; 273/400; 273/127 B

[58] Field of Search ..... 273/400, 411, 273/409, 401, 398, 127 B

[56] References Cited

U.S. PATENT DOCUMENTS

| | | | |
|---|---|---|---|
| D. 213,573 | 3/1969 | Adolph . | |
| D. 337,363 | 7/1993 | Pavonetti . | |
| 4,083,561 | 4/1978 | Daffer, Jr. . | |
| 4,127,272 | 11/1978 | Pennell . | |
| 4,407,507 | 10/1983 | Caruso et al. . | |
| 4,420,158 | 12/1983 | Klock et al. . | |
| 5,186,469 | 2/1993 | Terris | 273/411 |
| 5,316,314 | 5/1994 | Wilson | 273/400 |
| 5,372,368 | 12/1994 | Pavonetti . | |
| 5,413,356 | 5/1995 | Bigelow | 273/400 |

FOREIGN PATENT DOCUMENTS

| | | | |
|---|---|---|---|
| 2485379 | 12/1981 | France | 273/400 |
| 2636659 | 3/1990 | France | 273/411 |
| 2122323 | 11/1972 | Germany | 273/402 |
| 2448366 | 10/1974 | Germany . | |
| 2847701 | 5/1980 | Germany | 273/400 |
| 284604 | 11/1990 | Germany | 273/411 |

*Primary Examiner*—Mark S. Graham

*Attorney, Agent, or Firm*—Lackenbach Siegel Marzullo Aronson & Greenspan, PC.

[57] ABSTRACT

A collapsible soccer goal for an athletic field having a matched pair of vertical side supporting frame sections, and a crossbar beam having a plurality of horizontal sections. Each of the vertical and horizontal sections comprising a locking hinge enabling each of the sections to be folded in half. The plurality of horizontal sections are detachably connected together by clamping means to form the crossbar beam; and the vertical frame sections each having an overhead elongated hinge removably connectable to a horizontal section for supporting the crossbar beam in a hanging manner from the vertical side supporting frame sections.

31 Claims, 9 Drawing Sheets

190
174
200
202
118

5
51
120
118
52
120
91
61
50
91
52
51
120
118
120

52
90
50
90
52

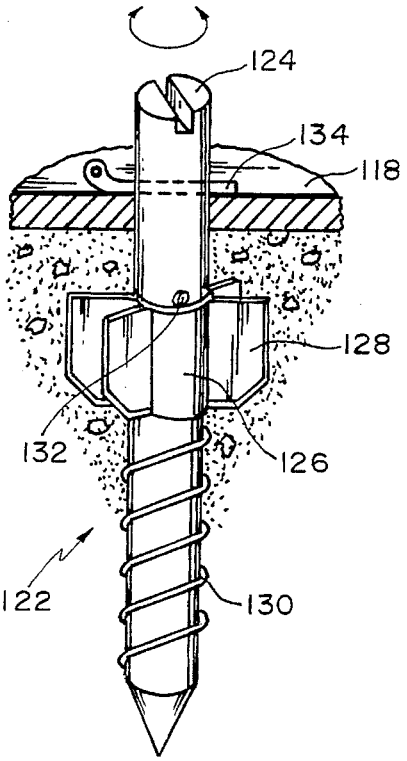
FIG. 6
FIG. 4B
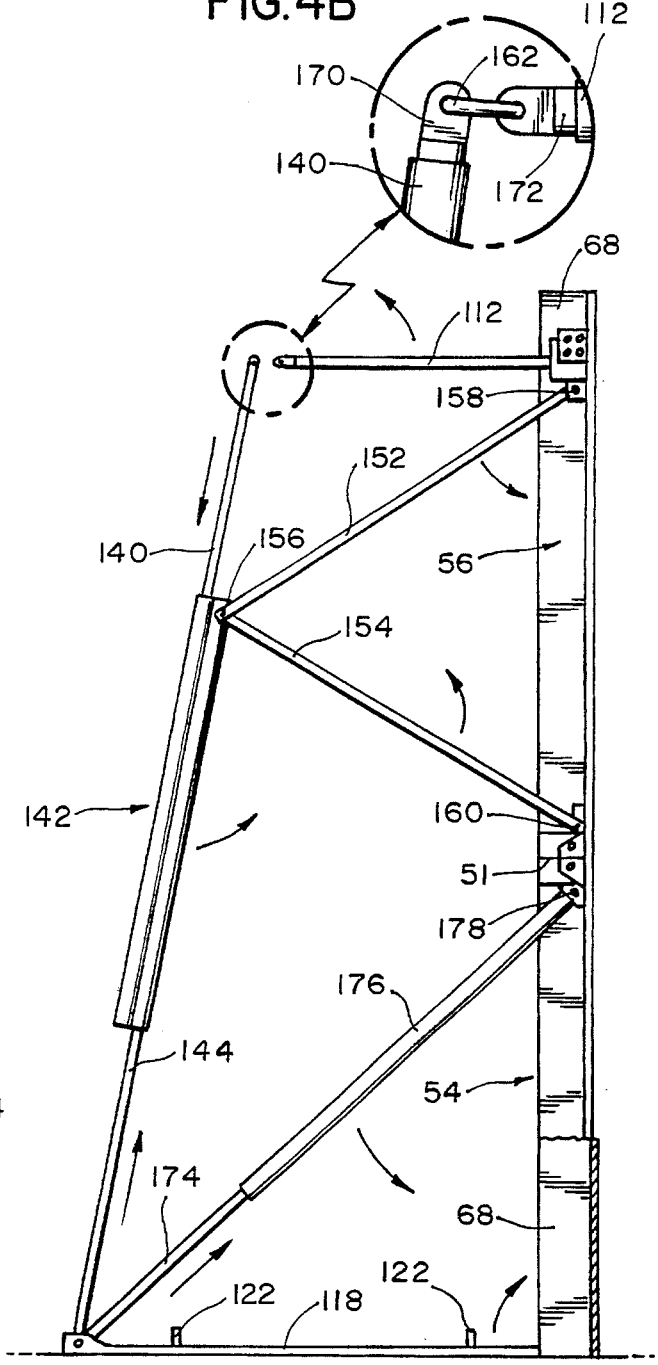
FIG. 4A
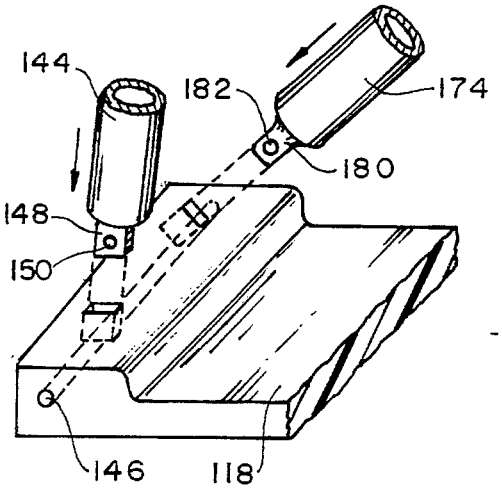
FIG. 5

(CENTER CROSSBAR BEAM JOINT)

116
92
158
152
142
112
56
94
154
100
59'
91
90
66'
178
176
54
68
70
174
122
120
118

68
76
80
72
74
78

94
142
92
152
112
154
56

68
80
76
72
74
78

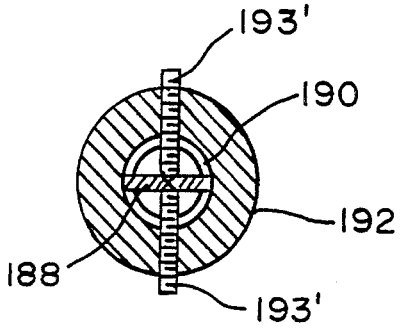
FIG. 26
FIG. 25
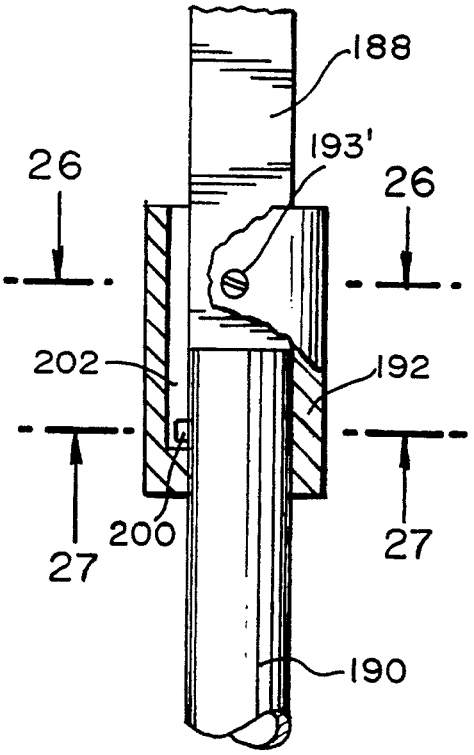
FIG. 27
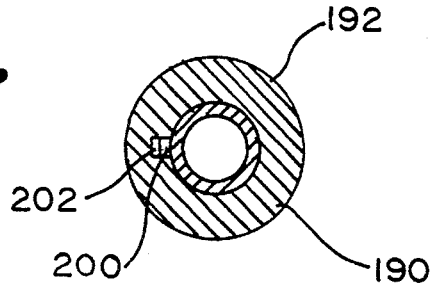

COLLAPSIBLE/PORTABLE SOCCER GOAL

FIELD OF THE INVENTION

The invention relates to a light weight and compact, self standing soccer goal when erected, and in particular to a portable and/or collapsible one which may be folded into a plurality of small packages (or boxes)which are readily transportable, and can be conveniently carried by a person and placed in a trunk of a car or a vehicle, whereby the goal can be placed readily by one person on any open field anywhere.

BACKGROUND OF THE INVENTION

Ball playing fields, such as for soccer and other sports are large in size and require considerable space. Many facilities, such as schools have limited funds or space, and consequently the same playing field is used for many different types of sports. Unfortunately, with such arrangements, considerable time is required to set up the field for each type of sport played. In the case of soccer, large, full size and uncollapsible goal posts are mounted on wheels for rolling same into position at opposite ends of the field, and these goal posts can only be transported from field to field on a flat bed truck. These movable goals are heavy and bulky, requiring considerable manpower or power equipment to move them from a remote level storage area nearby to the goal lines. Also, as these movable goals are not collapsible, they must be stored out in the open, and thus are subjected to the elements as well as vandalism. Frequently, the equipment is in need of repair due to such conditions such rigid goal posts require considerable time for set up and removal when a field is changed from one sport to another. These full size goal posts are about 9 feet high as one foot of each vertical post is inserted into coverable holes at the goal lines. Such embedded goal post ends keep the goals securely in position at all times.

Other soccer goal posts comprise nothing more than a series of telescoping poles connected to form the standard rectangular goal area set by the professional leagues (8 feet by 24 feet size opening), with a pair of rearward extending supporting poles running from the top two corners of the vertical goal poles to the ground. A net is then supported from all poles and fastened to the ground for catching all balls driven into the net. One of the disadvantages of this type of goal construction is that it can be very dangerous as a death has been reported where an athlete was impaled by one of the poles when the goal was broken up in a collision on the field. A further soccer goal specification requires that the poles and crossbar be 4 inches, as required by the National Collegiate Athletic Association.

Further goals are shown in the following literature:

| U.S. PATENT DOCUMENTS | | |
|---|---|---|
| 5,048,844 | 9/91 | Haseltine |
| 2,220,158 | 9/35 | Oakes, et al. |
| 4,702,478 | 10/87 | Kruse |
| 4,420,158 | 12/83 | Klock |
| 2,449,708 | 9/48 | Lindsay |
| 4,083,561 | 4/78 | Daffer,Jr |
| 4,127,272 | 11/78 | Pennell |
| 4,407,507 | 10/83 | Caruso |
| D 213,573 | 3/69 | Adolph |
| D 337,363 | 7/93 | Pavonetti |
| **FOREIGN PATENT DOCUMENTS** | | |
| 2,632,868 | 12/89 | France |
| 2,630,921 | 7/78 | Germany |

-continued

| | | |
|---|---|---|
| 2,335,693 | 1/75 | Germany |
| 2,448,366 | 4/76 | Germany |

The above references have many deficiencies, including the use of support/anchoring guy wires which players invariably trip over and are injured in a fall on the field.

Many injuries and fatalities have occured on athletic fields using existing soccer goal posts, and these accidents are due to a number of reasons, including improper installations, or the use of unanchored or poorly anchored goal posts. Many fatalities as reported by the New York State Department of Health (18) were due to falling soccer goal posts from 1979–1993. Thus, there is a need for improved goal posts for soccer which are normally not inclined to fall over due to its novel construction. In addition, some of the injuries and fatalities occured when unused soccer goals toppled over due to persons climbing aboard same. A collapsible/portable soccer goal clearly avoids such problems of fixed wheeled soccer goals, etc.

OBJECTS AND SUMMARY OF THE INVENTION

It is an object of the invention to provide a totally collapsible soccer goal which can be folded down into four relatively small elongated rectangular boxes which are lightweight and portable in that they can be carried by a man and transported in a car, even the trunk thereof so long as there is available therein a clearing for a six foot object by about 4 inches by 4 inches.

It is a further object of the invention to provide an improved collapsible and portable soccer goal which is lightweight in construction, but yet strong and stable when erected and set up for use.

A further object of the invention is to provide an improved soccer goal which meets all industry standards be they NCAA or professional; and to provide complete flexibility in that such novel soccer goal can be fabricated from various materials, such as wood, plastic or metal, such as lightweight metals and alloys, including aluminum, magnesium and alloys thereof.

BRIEF DESCRIPTION OF THE DRAWINGS

FIG. 4A is a typical side elevational view illustrating the side supporting elements or struts;

FIG. 4B is a greatly enlarged, fragmentary/detail view of the upper, rear corner linkage connection between the pair of struts shown therein;

FIG. 5 is an enlarged fragmentary view of the rear bottom corner, and illustrating means for securing in place the distal ends of the lower rear vertical brace member or strut and the lower angular strut;

FIG. 6 illustrates a means for securing the two side ground base to the turf or ground where the goal is to be anchored;

FIG. 25 is an alternate form of the translatable connecting element shown in FIG. 21 illustrating set screws arranged to engage the flat sides of the rear upper supporting element;

FIGS. 26 and 27 are cross-sectional views taken along the lines 26—26 and 27—27 of FIG. 25, respectively.

DESCRIPTION OF THE PREFERRED EMBODIMENTS

Figures 1, 2, 28:
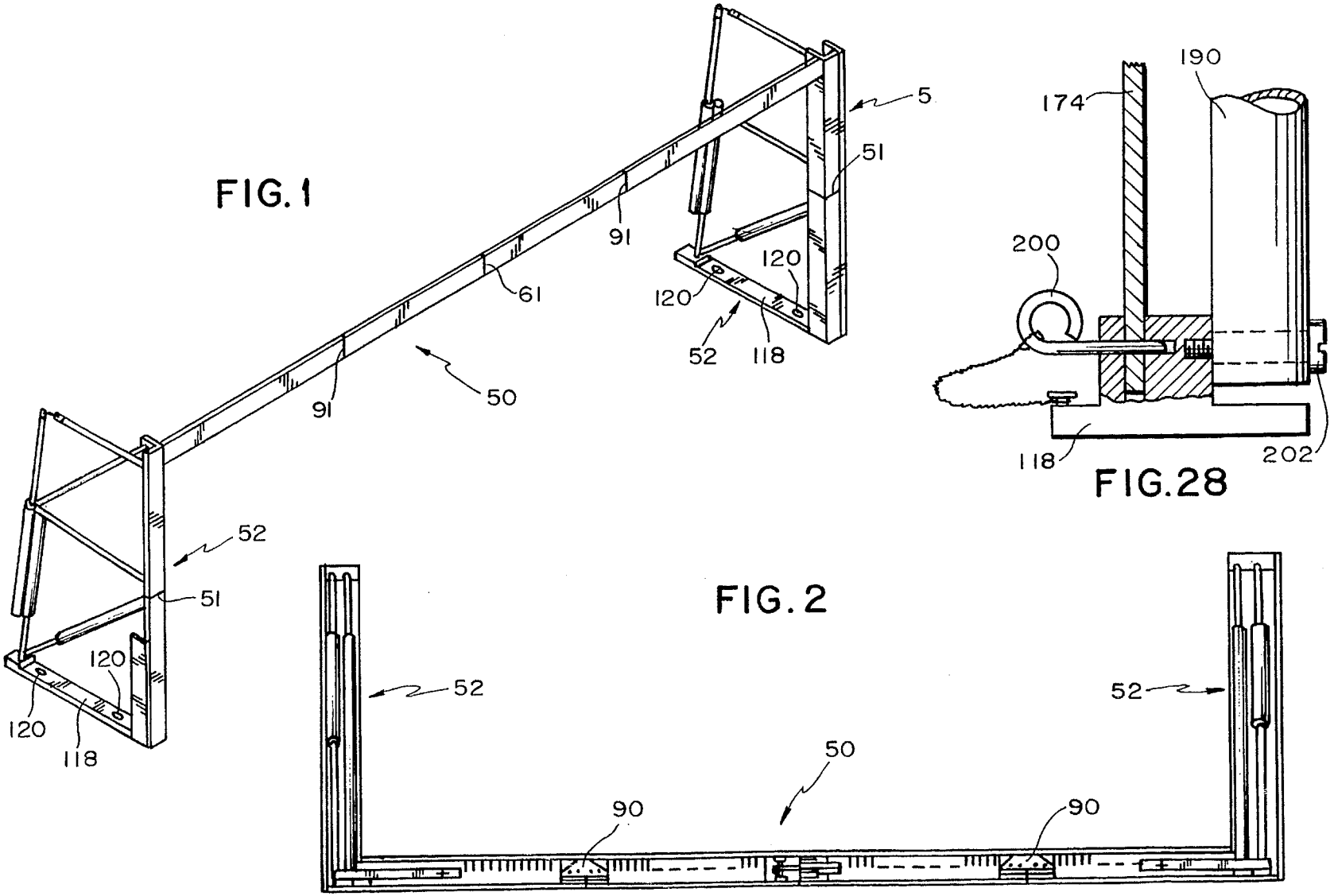
FIG. 1 is a front perspective view of my improved collapsible/portable soccer goal in the set-up condition.
FIG. 2 is a top plan view thereof.
FIG. 28 is another bottom corner detail, partly in section, showing means for securing in position two of the supporting elements or struts.
Figure 3:
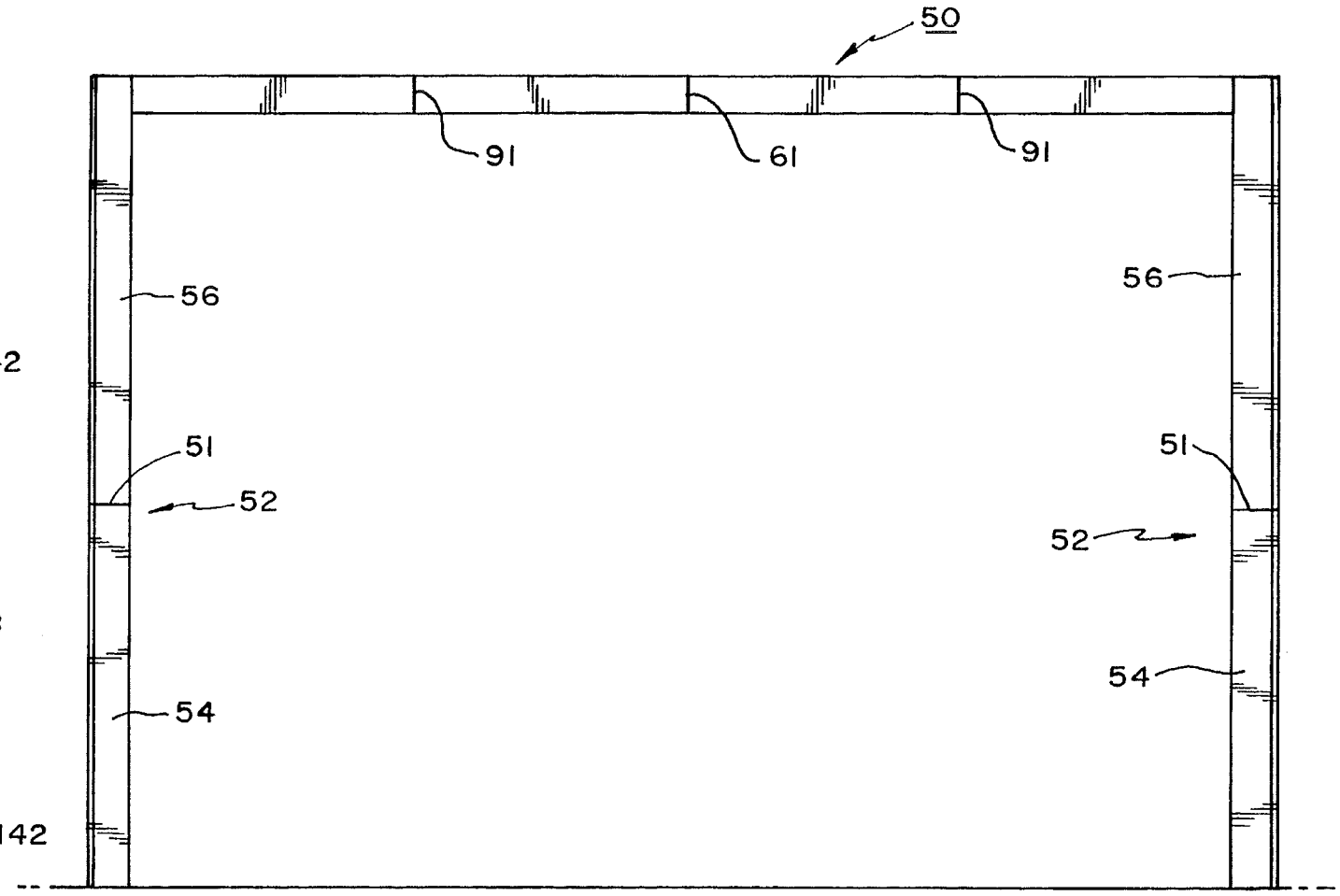
FIG. 3 is a front view thereof.

Referring now to the drawings wherein like numerals are employed for like elements, and more particularly to FIGS. 1–10, there is shown my novel soccer goal 50 of the present invention. As shown therein, the soccer goal comprises a pair of opposed side supporting structures 52 which support a top horizontal beam, that is a 24 foot (regulation) length four inch crossbar beam of right angle configuration. The soccer goal shown therein is collapsible in that the goal can be readily broken down into just four 4 inch×4 inch box-like structures as will be explained hereinafter. Each side supporting structure 52 forms a separate box (with the top crossbar beam forming two similar boxes); so that the folded side supporting structures and top beam with their back-to-back angled side flanges folded/hinged closed form four 4×4 inch boxes altogether for carrying same, as well as shipment and/or storage. In the case of the two side supporting structure 52 4"×4" boxes, same are about 4 feet long (4 ft. 2 inches); and the two crossbar beam 4"×4" boxes are 6 feet long. Thus, considerable savings in space is achieved with such a construction, and damage by vandals is eliminated entirely and a soccer field can virtually be set up in minutes as compared to the present conditions where manpower and/or machines are required to move heavy rigid soccer goals into position.

As best shown in FIGS. 4A and 4B, each side supporting structure comprises lower and upper angled 4 inch frame members, 54 and 56, respectfully. Each side of the angled frame members is a 4 inch face (regulation width), and one four inch face is directed to the field, with the other four inch face disposed on the inside of the vertical goal supports parallel to the other, and the bottom of the 4 inch crossbar beam facing the ground.

Figures 9, 10, 11:
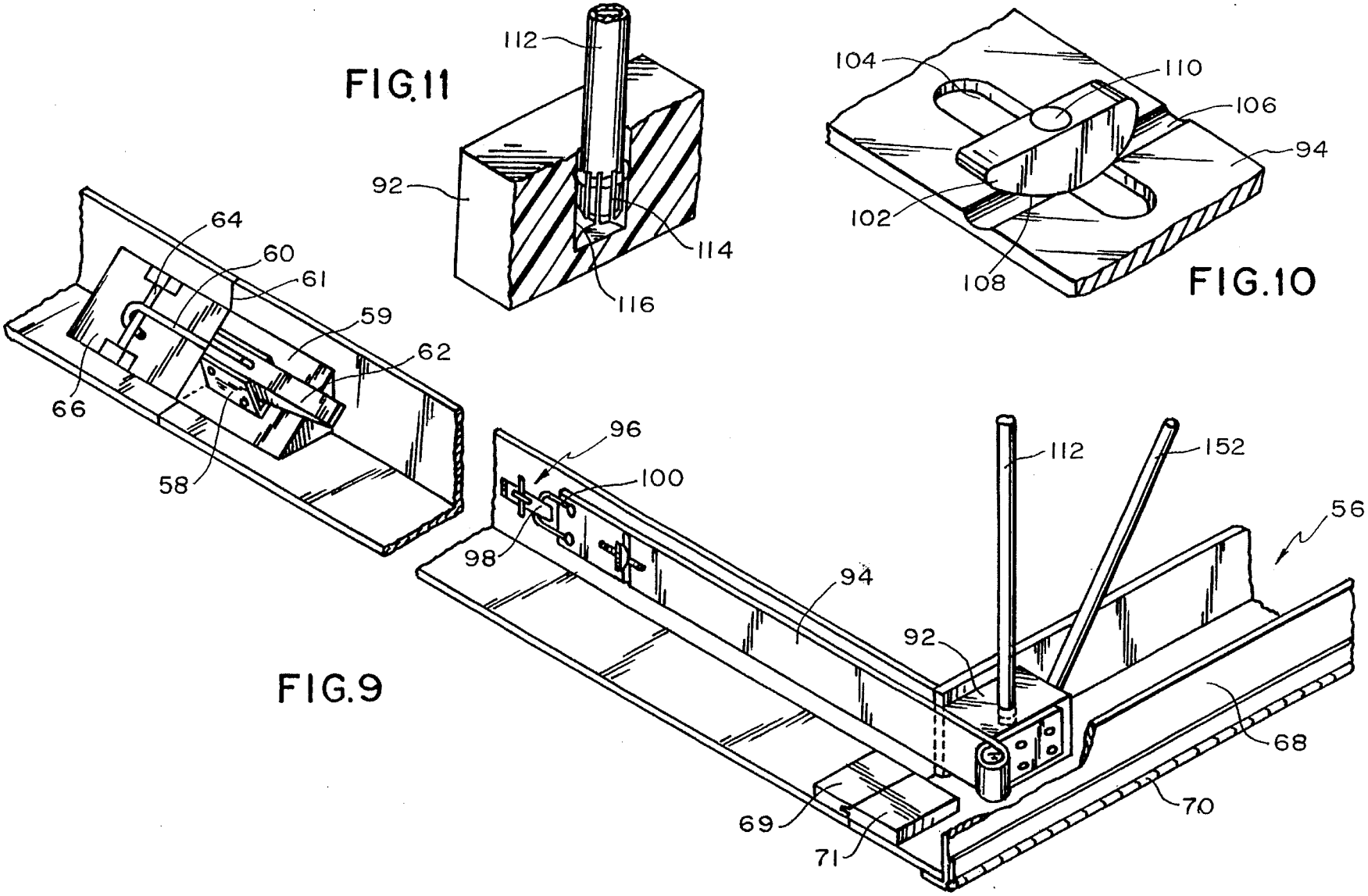
FIG. 9 is an enlarged fragmentary view illustrating one of the two corner crossbar members employed in supporting and maintaining level and straight the 24 foot horizontal top beam of the soccer goal.
FIG. 10 is a fragmentary view of an alternate mode for securing the corner crossbar member to the top beam.
FIG. 11 is a fragmentary detail view, partly in section showing one means for securing the top "two foot" rearward extending regulation strut for holding the net back 24 inches from the top beam.
Figure 14:
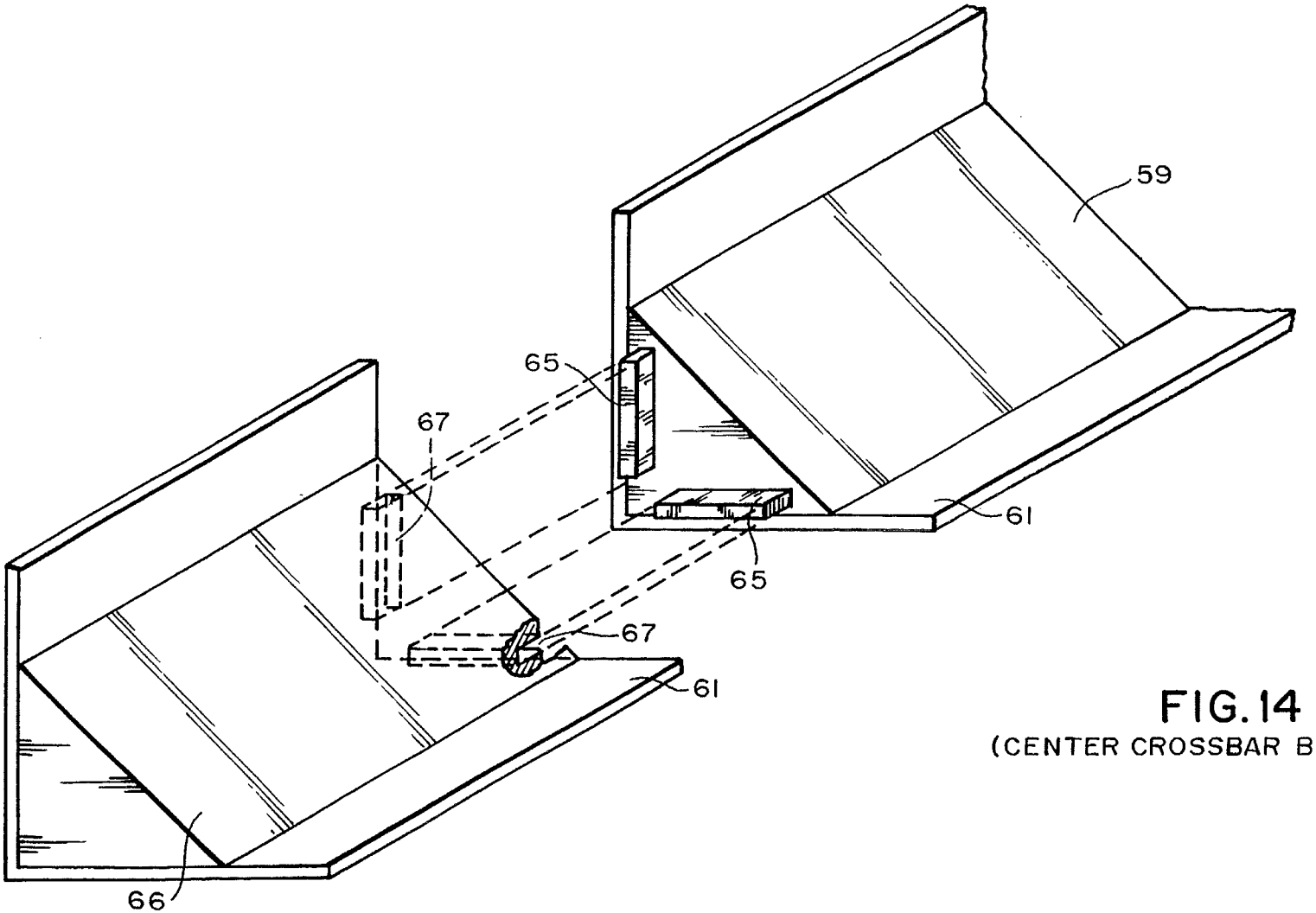
FIG. 14 is another fragmentary detail view in perspective of mating tongue and groove elements for the opposite beam parts of the 4 inch beam element.

The top beam is made up of four 6 foot sections (regulation goal zone or area being 8 feet high by 24 feet long), with the center thereof locked together, as best shown in FIG. 9 by means of a conventional latch 58 mounted on corner block 59 having a hook 60 and pull down handle 62 for applying tension to the hook 60 for gripping tightly the rung or bar 64 suitably secured to a corner block 66 also suitably mounted to the angled side flanges shown therein. Such corner blocks 59 and 66 are preferably provided with mating locking pins (not shown) or suitable tongue 65 and groove 67 elements, as are best shown in FIG. 14. With such construction, the faces of the 4 inch sides align up precisely, so that from the field the goal posts and top beams project a smooth clean solid beam of 4 inches for facing the playing field. In a like manner, suitable tongue and groove blocks 69 and 71 are employed at the corner zones for aligning adjacent angled side faces to each other so that a clear smooth flat continuous outer side surface faces the playing field.

Figures 15, 16, 17, 18:
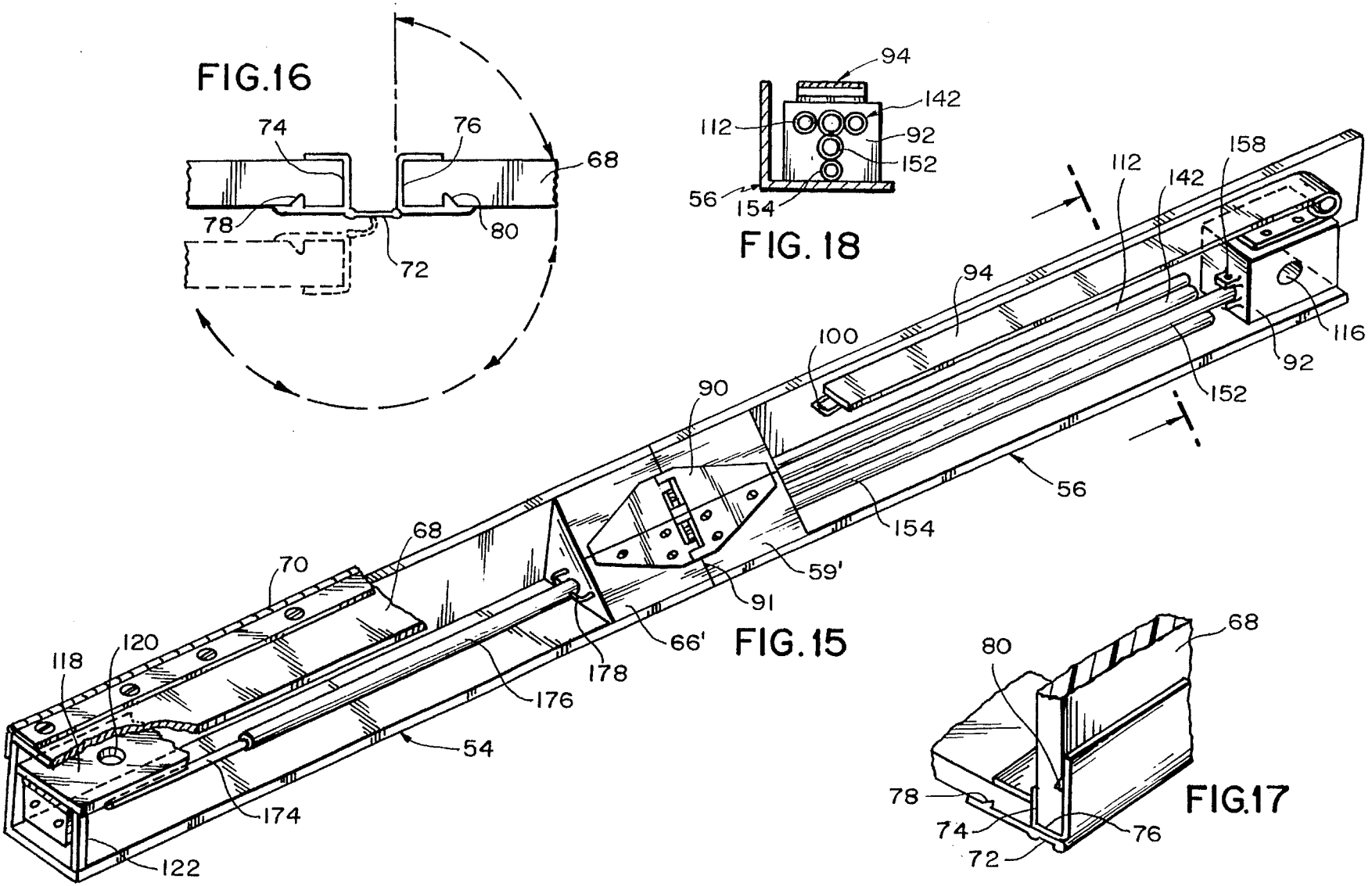
FIG. 15 shows one of the typical front side beams (unfolded), but all other elements or struts otherwise folded and "boxed" for portability.
FIGS. 16 and 17 are enlarged fragmentary views showing a conventional "living" plastic hinge with grooves having gripping means for securement to a panel or like element.
FIG. 18 is a cross-sectional view taken along lines 18—18 of FIG. 15.

Optionally, a third side wall panel 68, best shown in FIG. 9, may be suitably hinged at 70 for its full length so that no protruding end edge is exposed to a player. The hinge 70 enables the third side wall panel 68 to be folded flat against the adjacent side panel or at a right angle thereto as is best shown in FIGS. 16–17, respectively. In the embodiment of FIGS. 16–17, a conventional plastic living hinge 72 is shown connecting two grooves 74 and 76 having gripping means 78 and 80 in the form of a protrusion extending into a mating groove provided near the end edge of the 4 inch frame members.

It should be recognized that the third side wall panel 68 need not be provided along the 24 foot length of the top beam as there is no need to protect the front upper edge (facing the sky) of the 4" vertical goal beam. The front bottom edge being formed by the angled structure itself obviously needs no "protection" as it forms a complete corner with the adjacent side facing the ground. All such angled corners of all angled elements may suitably be rounded (not shown) so as to present no sharp edges along any edges of the improved soccer goal of the invention.

Figure 12:
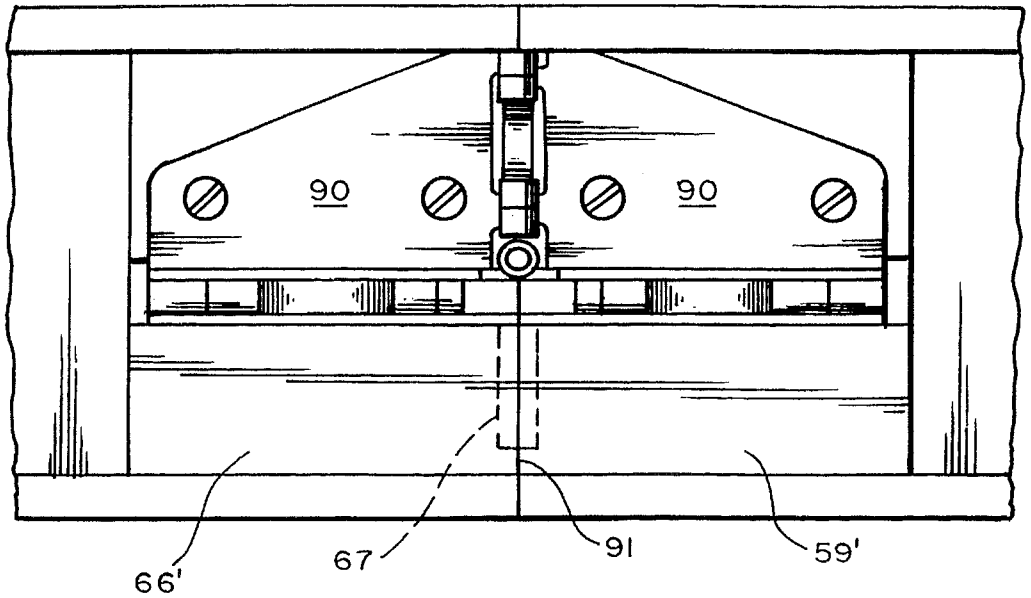
FIGS. 12 and 13 illustrate, respectively, plan and side elevational views of one of the four conventional locking hinges employed by the soccer goal, but shown in the locked position when the hinged halves holding the opposite parts are folded so as to form a straight 4 inch beam element.
Figure 13:
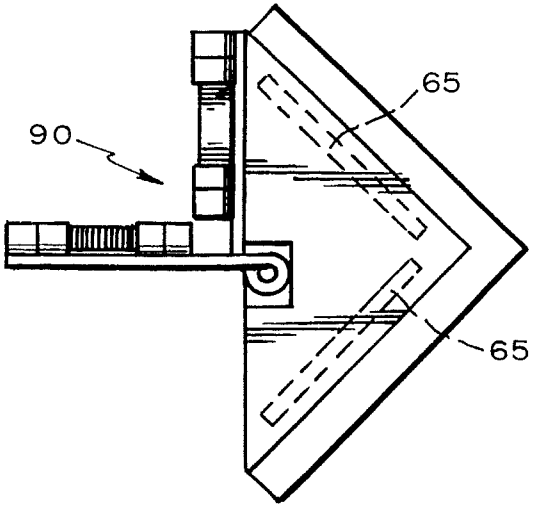

As shown in FIGS. 12 and 13, corner blocks 59' and 66' may be suitably fabricated of wood, plastic or metal, and same are secured to the inside of the angled side faces of the top beam and vertical side supporting structures 54, 56. Each set of blocks, except for the center of the top beam (FIG. 9) is provided with a conventional locking hinge 90 available in the marketplace. Thus, four locking hinges are required for enabling the vertical side supporting structures 54 and 56 to fold back upon each other; and for the two halves of the top beam to be folded into quarters by virtue of the locking hinges employed at the quarter point marks along the top beam (see FIG. 2 for best results in understanding this feature of the invention). Each locking hinge functions to lock itself and the structure it is holding together. While folded about itself, the locking hinge lays flat, but when in use, the hinge is angled at 90 degrees to prevent folding. Folding the sections about each other occurs when the angled hinge is flattened out.

As best shown in FIG. 9, each upper angled side frame members 56 comprising two side faces at least one of which supports a block 92 for a hinged crossbar supporting member 94 mounted on a side of the block 92 by means of a plurality of screws or pins fastening the small half of the 270 degree swinging hinged cantilevered crossbar member 94 to block 92. This supporting member 94 is important in the overall structure as it has a "long reach" and thus substantially provides the top beam with a very flat (not sagging) appearance so that the top beam is always substantially parallel to the ground. Such long cantilevered cross bar member 94 is locked to the top beam by a suitable tensioning latch 96 with hook means 98 for grabbing a loop 100 suitably provided at the end of the strap 94 for putting strap 94 under tension and tightly securing in place the cantilevered crossbar member 94 to the pair of side frame members for forming a soccer goal which has smooth flush 4"×4" faces in accordance with U.S. soccer regulations. Such latch 96 may be of the type shown by reference numeral 58. Other latch means in the form of a pivotally mounted turn key member 102 which when aligned with slot 104 in crossbar member 94 passes through same, and when turned or rotated 90 degrees is locked in place by detent means or groove 106 in the crossbar member 94, thereby supporting from above the suspended crossbar beam at the quarter points of the 24 foot span. The turn key member 94 is suitably curved at its bottom edge 108 so as to facilitate rotation about the crossbar member 94. Also, the pivot means 110 is provided with sufficient "play" so that one can readily lock such latch means without the need for any tools, such as a plier or wrench. It should be recognized that the crossbar member 94 is elongated and made of strong metal so that upon being cantilevered about block 92, its free or distal end completely supports the top soccer crossbar beam which comprises four six-foot length sections for a total span of 24 feet.

Also shown in FIG. 9 is the rearwardly extending net support element or strut 112 which is removably positionable within block 92 by means of a strong frictional gripping element 114 suitably secured in a blind aperture or hole 116 in the block 92.

As best shown in FIG. 15, each side supporting structure 52 includes a pivotable base 118 which is provided with apertures 120 so that when folded outwardly from a suitable mount 122 secured to the lower side supporting structure 54, suitable means, such as driving and/or auger stakes for securing the goal to the ground or turf may be driven into the apertures 120 so that the goal is locked in place and is immovable. Of course, weights, such as sandbags, can be placed on the two bases 118 so as to maintain the goal in place. Where stakes are utilized, four are preferred, two near the rear of the bases 118 and the other two near the front of the bases 118.

An example of suitable anchoring means is shown in FIG. 6 as 122. Such a device is known as Threes available from the International Supply Co. of Upper Darby, Pa., 19082. Such devices are simply installed by rotating the stake by means of a large screwdriver or torque bar placed across the slot 124. The stakes 122 must all be placed into the ground first. A loosely fitted collar 126 with a plurality of fins 128 freely rotates between the auger threads 130 and the pin 132 about the stake 122, but gets wedged and anchored into the ground as the stake is further driven by rotation into the ground. A locking pin 134 or other suitable rod or cotter pin may be passed through an aperture in the upper end of the stake 122 for precluding the base 118 from being lifted off the ground. Such pin 134 may be conveniently chained to the upper surface of the base 118 so that the pins 134 are not lost each time the goal is set up or broken down. In fact, any loose fasteners or other elements used with the collapsible goal of the present invention are all chained or otherwise "tied" to the basic apparatus so that none are lost in shipment or while in storage. Each stake is designed to take loads up to 100 KN (about 22,500 lbs.). Such load conditions depend on stabilizer surface area and type of ground conditions. Removal is just by counter rotation once the goal is lifted off the top of the stakes 122.

Referring now to FIGS. 1–9, and 15–27, the overall structural parts of the collapsible/portable soccer goal are shown in both their erected condition and folded down or unerected condition. As shown therein each side supporting frames 52 are substantially identical (matched-left and right units) or mirror images of each other and with their cantilevered or overhanging beam element or crossbar member 94 support the overhead 24 foot long horizontal standard 4 inch goal crossbar. Such a structure is clean and unencumbered. One example of other type soccer goals is the combination soccer and football goals which employs a "sideways ladder" truss structure atop the horizontal 24 foot crossbar for supporting a pair of upright extending high football goal posts. Many erroneous goals have been called where a soccer ball is deflected by a vertically disposed ladder rung member into the field and maintained in play especially when it ricochets faster than one can see and bounces in front of the goal. In reality, the ball was clearly "out of play" as it would have sailed out of bounds were it not for the truss above the horizontal goal crossbar beam. Thus, the goal of the present invention completely eliminates the possibility of any such incorrect judgment calls as there is no extra frame members or structure facing the playing field other than the standard 4 inch horizontal crossbar beam and the two vertical posts.

Each side supporting frame 52 comprises two 4 foot 2 inch sections 54,56 foldable about a locking hinge 90 mounted on the corner blocks 59' and 66'. Split (equal lengths) third side wall panels 68 running the full length of the sections 54, 56 are optional, but preferred as they protect players from the goal's outer vertical corner edging, while at the same time shield the locking hinges and the connecting areas for the elements or struts should players run and impact into the front portions of the vertical side supporting frames.

As shown in the said Figures, the supporting elements or struts are a plurality of braces which join together to form a high strength side frame, but yet is of very light weight in construction so that the soccer goal can be folded up and packaged into just four similar elongated "boxes" of dimensions no larger than about 4"×4" by 4 feet 2 inches or in the case of the top crossbeam, 6 feet long. It will be appreciated that the side supporting frames function to support the overall goal itself and the horizontal overhead 4" beam facing the playing field, while at the same time hold the soccer net (not shown) in place about the sides, rear and top which must have at least a 2 foot depth to the net, in order to conform to soccer league regulations.

As shown, each side frame comprises a top element or strut 112 extending rearwardly, and a plurality of rear elements or struts 140, 142, 144. The upper element or strut 140 telescopes out from the middle element or strut 142, while the lower element or strut 144 is fixed in base 118, as best shown in FIG. 5 by suitable pin means 146 extending through an aperture 148 in an end plug 150 secured to the lower element or strut 144. Thus, element 144 folds flat down against base 118 in the collapsed storage position (not shown in FIG. 15). A pair of upper internal reinforcing elements or struts 152 and 154 are likewise suitably removably pinned to element strut 142 at 156, and their other ends are suitably pivotally mounted at 158 and 160.

Figure 7:
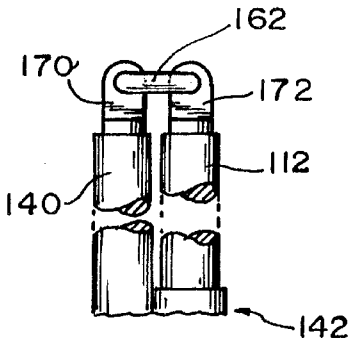
FIGS. 7 and 8 show typical means for connecting two struts together where the means enables the struts to be folded back and placed in parallel to each other.
Figure 8:
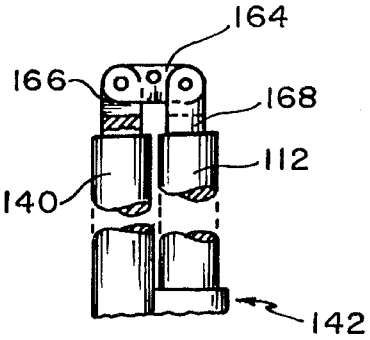

A detail of the top rear corner of the side frames is shown in FIG. 4B, and with the folded parallel storage position shown in FIG. 7. The elements/struts 112 and 140 must be free to pivot about their connected ends, and any suitable means for doing same is applicable to the invention. For example, link 162 may freely connect the ends of elements/struts 112 and 140 so that they rotate and/or pivot about each other. Such connection may be of a single closed chain type link which is relatively "loose" in the sense that there is sufficient play enabling assembly and disassembly of such parts with ease. An alternate form of connection may be the use of a flat rigid link 164 between forked end plug elements 166 and 168 secured to or formed from the elements/struts 112 and 140, as is best shown in FIG. 8. Obviously, end plug elements 170 and 172 of FIG. 7 need not be of the forked type as the elements/struts 112 and 140 are "hooked" together in such a fashion to enable positioning of the struts in place while at the same time providing adequate strength and rigidity to the overall side frame.

Lastly, lower internal telescoping element/strut 174 extends from the element/strut 176 which is pivotally mounted at 178 of the corner frame 54. As best shown in FIG. 5, element/strut 174 is suitably provided with end plug 180 having an aperature 182 which receives pin 146 or suitable pin means for locking same in position when the side frame is erected. The reference arrows used throughout the various views show and illustrate the direction of rotational movement of the elements/struts when folded into the corner frames shown in FIG. 15. Other arrows show translational movement where applicable.

In FIGS. 19–28, an alternate side framing structure is illustrated. As shown therein, the side frame comprises similar right angle corner elements 54' and 56' and base 118 with like lower internal elements/struts 174 and 176, which may be suitably pinned at 178 for locking the struts together to form an elongated unitary rigid internal supporting element or strut. The top element/strut 180 rotates or folds down about pin means or axis 182 and its support block 184 so as to reside within the upper angled corner frame 56'. It should also be recognized that all telescoping elements used in the invention may be suitably locked in place by preferably one internally stepped detent (not shown). In this way, the extendible element/strut can be withdrawn until the detent (protrusion or spring-loaded ball and groone) locks in position. Such a design enables quick assembly and precludes one from extending any element/strut longer than is necessary when the apparatus is being erected or assembled from the packed storage condition.

Rear elements/struts comprise upper members 186 and 188 with a suitable conventional locking pivot pin 189 holding such members rigid inline with each other, as well as lower member 190 which is suitably tubular in shape, such as round, square or can even be polygonal in shape. As best shown in FIG. 28, lower internal strut 174 is suitable removably held about an axis to base 118 by pin means 200 passing through the strut 174. Also, lower member or strut 190 is removably and pivotably held to the same block or mounting means provided on base 118 for the strut 174, but it is held by a suitable shoulder type screw/pin fastener 202. Note struts 180,186, 188 and 190 are made sufficiently strong so as to withstand all impact forces as well as forces exerted on the goal itself by kicked soccer balls, etc. In addition, depending on the strength of various materials, it is possible that struts 174 and 176 can be eliminated, but are preferable for aiding in precluding the goal from tipping over by unusually large impact forces slamming high up on the goal.

Figure 24:
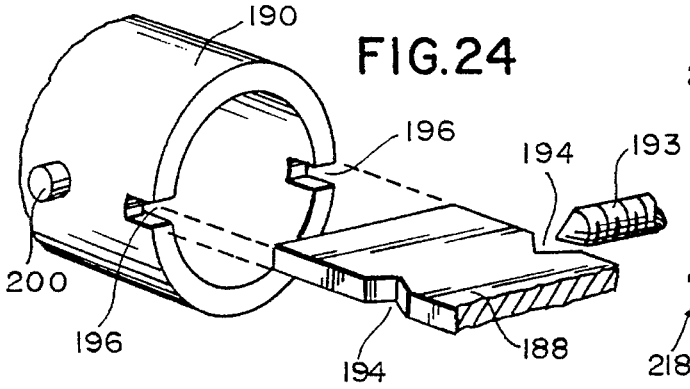
FIG. 24 is an enlarged fragmentary view in perspective of the locked connection of FIG. 21, but shown in an exploded (unconnected) condition with a pair of set screws engaging notches in the flat rear upper supporting element.

Between elements/struts 188 and 190, a sleeve-like member 192 suitably pinned or secured to strut 188 by any suitable means, such as set screws or thumb screws 193. These screws 193 engage grooves or notches 194 on both end edges of element/strut 188. Also, as best shown in FIG. 24, the strut 188 is engaged with strut 190 by means of the grooves 196 that lock element/strut 188 in position when erected and connected with the lower rear supporting member/strut 190.

Alternatively, as shown in FIGS. 25–27, at least one or a pair of set screws or thumb screws 193' engage at least one aperture in the flat side of strut 188 in lieu of the end edges. Either embodiment is sufficient for locking the two rear supporting elements in place. With both arrangements, a protrusion 200 on the outside surface of strut 190 engages a suitable slot 202 in sleeve 192 for providing correct alignment of the elements/struts 188, 190 when assembled together. When two set screws 193' are employed, it is preferred that each one engage a separate aperture in strut 188 so as to solidly lock the strut to sleeve 192 and strut 190.

Figure 20:
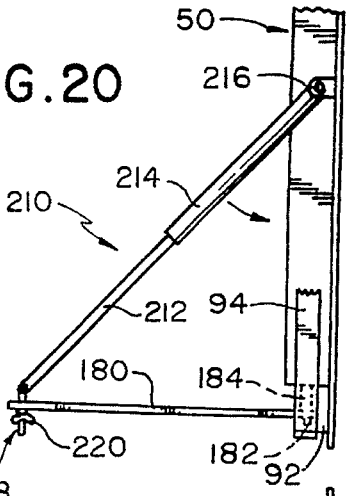
FIG. 20 is a fragmentary, top corner plan view of the side supporting structure showing a diagonally pivoted brace for the two toot rearwardly extending net support element.
Figure 22:
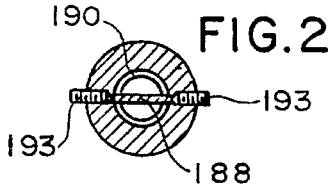
FIGS. 22 and 23 are cross-sectional views taken along the lines 22—22 and 23—23 of FIG. 21, respectively.
Figure 21:
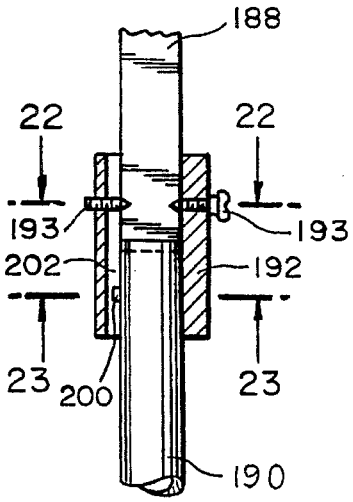
FIG. 21 is an enlarged detail view of the translatable connecting element locking the round lower and flat upper rear supporting elements or struts together.
Figure 23:
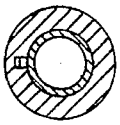
Figure 19:
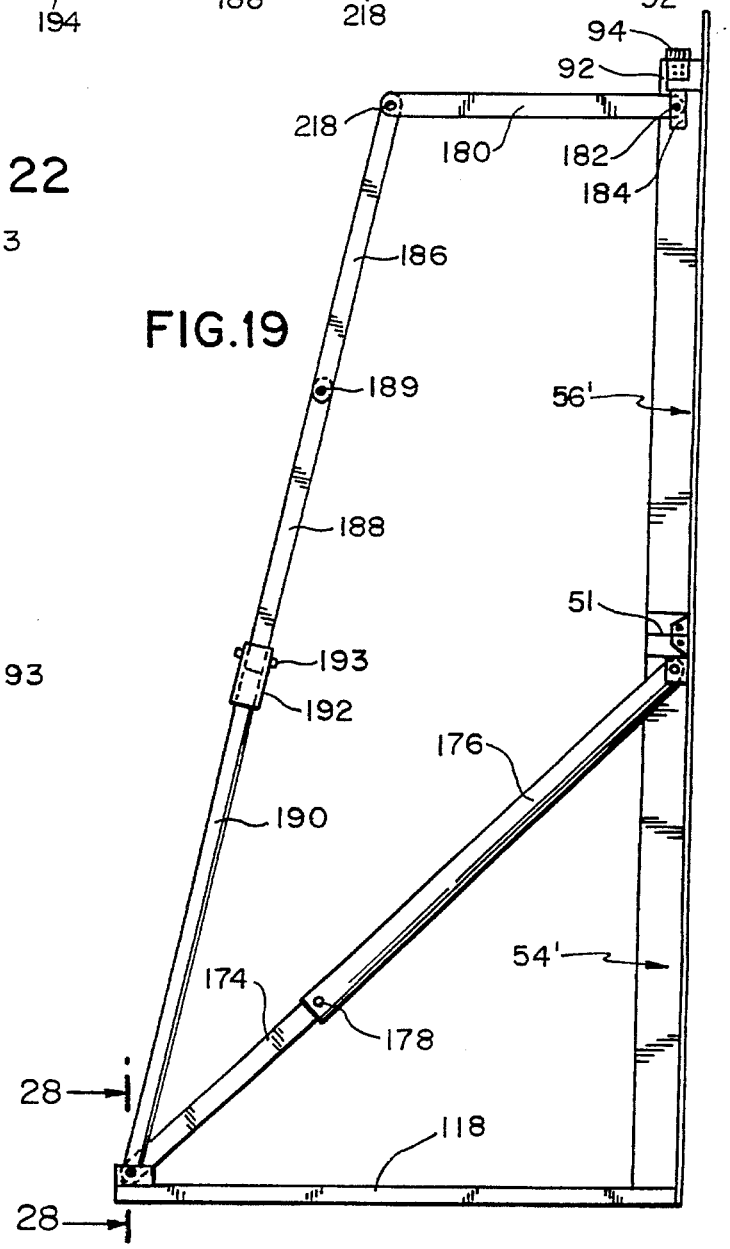
FIG. 19 is an alternate side supporting structure.

As best shown in FIG. 20, and if desired, the soccer goal of the invention may also be provided with typical corner bracing elements/struts, each one extending inwardly at about a 45 degree angle from a side frame structure. Here the corner bracing element/strut 210 shown comprises inner and outer elements 212, 214, respectively which are suitably of the type which telescope, but can also be of the type formed by struts 186 and 188, if desired. Outer element 214 is suitably pivotally mounted to the right angled top crossbar beam at 216; and the inner element 212 is suitably removably locked to upper rear corner pins means 218 passing through the elements 180 and 186 by a common fastener element extending through aperture means (not shown) in strut 180 by means of a thumb screw 220. It should also be apparent that pivot means 158 of FIG. 4A and pivot means 182 are located on the same block 184 for supporting strut 152 and strut 180, respectively, in each of the side frame embodiments of the invention.

It should also be recognized that all of the telescoping elements or struts can be suitably locked by detent means as noted herein when their desired total length is reached. Also, the right angle elements are substantially at 90 degrees and preferably integrally formed, but they may be made of two pieces for economy or ease of construction.

Although the present invention has been described in some detail by way of illustration and example for purposes of clarity and understanding, it will, of course, be understood that various changes and modifications may be made with the form, details, and arrangements of the parts without departing from the scope of the invention as set forth in the following claims.

What is claimed is:

1. A collapsible soccer goal for an athletic field comprising: a matched pair of vertical side supporting frame sections, and a crossbar beam having a plurality of horizontal sections; each of said vertical and horizontal sections comprising a locking hinge enabling each said section to be folded in half; said plurality of horizontal sections being detachably connected together by clamping means to form said crossbar beam; and said vertical frame sections each having an overhead elongated hinge removably connectable to a horizontal section for supporting said crossbar beam in a hanging manner from said vertical side supporting frame sections.

2. The collapsible soccer goal according to claim 1, wherein each vertical side supporting frame section, and each said horizontal section comprises two right angle elements.

3. The collapsible soccer goal according to claim 2, wherein each said vertical side supporting frame section comprising two right angle elements hingeably connected by means of said locking hinge, and a plurality of struts for supporting said right angle elements.

4. The collapsible soccer goal according to claim 3, wherein a set of struts are erectable into a frame position from a stored position in one of said halves of said vertical sections.

5. The collapsible soccer goal according to claim 2, wherein each said overhead elongated hinge is fastened to one of said right angle elements of said horizontal sections by means of a pivotable lock.

6. The collapsible soccer goal according to claim 3, wherein each said vertical frame section when folded in half about said locking hinge form a box by means of said two right angle elements mating together, with said plurality of struts all fitting within said box, so as to form a compact portable package.

7. The collapsible soccer goal according to claim 2, further including a net secured to each said angle element of all said right angle elements forming said pair of vertical side supporting frame sections and said horizontal sections.

8. The collapsible soccer goal according to claim 7, wherein said net is secured by means of a plurality of hooks attached to all of said angle elements.

9. A collapsible soccer goal for an athletic filed comprising: a matched pair of vertical side supporting frame sections, and a crossbar beam having a plurality of horizontal sections; each of said vertical and horizontal sections comprising two right angle elements, and a locking hinge enabling each said section to be folded in half; said plurality of horizontal sections being detachably connected together by clamping means to form said crossbar beam; said vertical frame sections each having an overhead elongated hinge removably connectable to a horizontal section for supporting said crossbar beam in a hanging manner from said vertical side supporting frame sections; each said vertical side supporting frame section comprising two right angle elements hingeably connected by means of said locking hinge, and a plurality of struts for supporting said right angle elements and forming a draped net outline; and a set of struts are erectable into a frame position from a stored position in one of said halves of said vertical sections; said set of struts including at least a top strut parallel to said athletic field and connectably extending from said one half of said vertical section; and at least a plurality of rear struts connected to said top strut and generally facing opposite to said right angle elements.

10. The collapsible soccer goal according to claim 9, wherein said plurality of rear struts comprise at least a pair of telescoping elements.

11. The collapsible soccer goal according to claim 10, wherein said pair of telescoping elements extend outwardly from a further rear strut and in opposite directions from each other.

12. The collapsible soccer goal according to claim 9, further including at least one diagonal strut collapsibly extending between said one of said halves of said vertical sections and said plurality of rear struts.

13. The collapsible soccer goal according to claim 12, wherein said at least one diagonal strut are two struts fixedly pivoted to one of said plurality of rear struts.

14. The collapsible soccer goal according to claim 9, further including a base strut pivotably connected to the other half of said vertical section and to one of said plurality of rear struts.

15. The collapsible soccer goal according to claim 14, further including a diagonal strut collapsibly extending between said other half of said vertical section and to an end of said base strut opposite from said pivot connection.

16. The collapsible soccer goal according to claim 14, including means for anchoring said base strut to the athletic field.

17. The collapsible soccer goal according to claim 14, wherein said plurality of rear struts comprise at least a plurality of folding rear struts connected to each other.

18. The collapsible soccer goal according to claim 17, wherein said plurality of folding rear struts are lockingly pinned to each other and unfoldably extend in line to pivotably connect one end thereof to said top strut opposite from the connection of said top strut to said one half of said vertical section.

19. The collapsible soccer goal according to claim 17, further including a pivotable rear strut connectable to an end of at least one of said plurality of folding rear struts to form a line of rear struts facing opposite to said right angle elements.

20. The collapsible soccer goal according to claim 17, further including a base strut pivotally connected to the other half of said vertical section and to one of said plurality of rear struts.

21. The collapsible soccer goal according to claim 17, further including a diagonal strut collapsibly extending between said other half of said vertical section and to an end of said base strut opposite from said pivot connection.

22. The collapsible soccer goal according to claim 20, wherein said pivotable rear strut is tubular in form, and said plurality of folding rear struts are two flat bars pivotably secured together by means of a locking pin.

23. The collapsible soccer goal according to claim 22, wherein said tubular rear strut is connectable to an end of at least one of said two folding rear struts by means of a translatable sleeve provided on said tubular rear strut and locking means provided on said tubular sleeve for locking in place said another end of said two folding rear struts and fixedly holding same in said tubular sleeve.

24. The collapsible soccer goal according to claim 23, wherein said translatable sleeve is provided with an internal blind channel, and said tubular rear strut is provided with means mating with said channel for preventing said translatable sleeve from being removed from said tubular rear strut.

25. The collapsible soccer goal according to claim 23, further including an alignment means on said tubular rear strut and engagement means on said end of at least one of said two folding rear struts; and said alignment means mating with another end of said at least one of said two folding rear struts for aligning said engagement means with said locking means; and said locking means mating with said engagement means.

26. The collapsible soccer goal according to claim 25, wherein said engagement means comprise notches on opposite surfaces of said another end of said two folding rear struts.

27. The collapsible soccer goal according to claim 26, wherein said locking means comprise a pair of threaded elements engageable with said notches on the opposite surfaces of said another end of said two folding rear struts.

28. The collapsible soccer goal according to claim 25, wherein said engagement means comprises at least one aperture in said another end of said two folding rear struts.

29. The collapsible soccer goal according to claim 28, wherein said locking means comprises at least one threaded element passing through said at least one aperture.

30. The collapsible soccer goal, according to claim 9, wherein said crossbar beam and said pair of side supporting frame sections form a goal zone, and said overhead elongated hinges lock said pair of vertical side supporting frame sections to said crossbar beam by tensioning means connectable to said overhead elongated hinges.

31. The collapsible soccer goal according to claim 9, wherein a split hingeable side wall is connected to one of said two right angle elements of each of said pair of vertical side supporting frame sections so as to form a U-shape, whereby said locking hinges may be shielded for safety purposes.

* * * * *